US010443110B2

(12) United States Patent
Kitsuya et al.

(10) Patent No.: US 10,443,110 B2
(45) Date of Patent: Oct. 15, 2019

(54) HIGH TOUGHNESS AND HIGH TENSILE STRENGTH THICK STEEL PLATE AND PRODUCTION METHOD THEREFOR

(71) Applicant: JFE STEEL CORPORATION, Tokyo (JP)

(72) Inventors: Shigeki Kitsuya, Tokyo (JP); Katsuyuki Ichimiya, Tokyo (JP); Kazukuni Hase, Tokyo (JP); Teruhisa Kinugawa, Tokyo (JP); Naoki Matsunaga, Tokyo (JP); Kenji Hayashi, Tokyo (JP); Masayuki Horie, Tokyo (JP); Yusuke Terazawa, Tokyo (JP); Shigeru Endo, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 90 days.

(21) Appl. No.: 15/126,838

(22) PCT Filed: Sep. 9, 2014

(86) PCT No.: PCT/JP2014/004631
§ 371 (c)(1),
(2) Date: Sep. 16, 2016

(87) PCT Pub. No.: WO2015/140846
PCT Pub. Date: Sep. 24, 2015

(65) Prior Publication Data

US 2017/0088913 A1 Mar. 30, 2017

(30) Foreign Application Priority Data

Mar. 20, 2014 (JP) ..... 2014-058611

(51) Int. Cl.
*C21D 9/46* (2006.01)
*C22C 38/54* (2006.01)
(Continued)

(52) U.S. Cl.
CPC ..... *C21D 9/46* (2013.01); *B21J 5/02* (2013.01); *B22D 11/001* (2013.01); *C21D 1/18* (2013.01);
(Continued)

(58) Field of Classification Search
None
See application file for complete search history.

(56) References Cited

U.S. PATENT DOCUMENTS 9,945,015 B2 4/2018 Yuga et al.
10,000,833 B2 6/2018 Kitsuya et al.
(Continued)

FOREIGN PATENT DOCUMENTS

CN 101341269 A 1/2009
CN 101962741 A 2/2011
(Continued)

OTHER PUBLICATIONS

US translation of JP 2008 308736 (Year: 2008).*
(Continued)

*Primary Examiner* — Jeffrey D Washville
(74) *Attorney, Agent, or Firm* — RatnerPrestia

(57) ABSTRACT

A high toughness and high tensile strength thick steel plate has a plate thickness of 100 mm or more, wherein a reduction of area in a center of the plate thickness by tension in a plate thickness direction is 40% or more. Thus, a high tensile strength thick steel plate with excellent strength and toughness in a center of the plate thickness can be obtained with no need for a larger production line, even in the case of producing a high strength thick steel plate for which the addition amount of alloying element needs to be increased.

16 Claims, 1 Drawing Sheet

(51) Int. Cl.

| | |
|---|---|
| ***C22C 38/50*** | (2006.01) |
| ***C22C 38/48*** | (2006.01) |
| ***C22C 38/46*** | (2006.01) |
| ***C22C 38/44*** | (2006.01) |
| ***C22C 38/42*** | (2006.01) |
| ***C22C 38/06*** | (2006.01) |
| ***C22C 38/04*** | (2006.01) |
| ***C22C 38/02*** | (2006.01) |
| ***C22C 38/00*** | (2006.01) |
| ***C21D 8/02*** | (2006.01) |
| ***C21D 1/18*** | (2006.01) |
| ***B22D 11/00*** | (2006.01) |
| ***B21J 5/02*** | (2006.01) |
| ***C22C 38/58*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C22C 38/18*** | (2006.01) |
| ***C22C 38/32*** | (2006.01) |
| ***C21D 7/13*** | (2006.01) |
| ***C21D 8/00*** | (2006.01) |
| ***C21D 9/00*** | (2006.01) |

(52) U.S. Cl.

CPC ..... *C21D 7/13* (2013.01); *C21D 8/005* (2013.01); *C21D 8/0205* (2013.01); *C21D 8/0226* (2013.01); *C21D 8/0263* (2013.01); *C21D 9/0081* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/18* (2013.01); *C22C 38/32* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C22C 38/58* (2013.01)

(56) References Cited

U.S. PATENT DOCUMENTS

| | | | |
|---|---|---|---|
| 2014/0246131 | A1 | 9/2014 | Yuga et al. |
| 2014/0346121 | A1 | 11/2014 | Poeschl et al. |
| 2015/0203945 | A1 | 7/2015 | Ichimiya |
| 2016/0010192 | A1 | 1/2016 | Kitsuya et al. |
| 2017/0088913 | A1 | 3/2017 | Kitsuya et al. |

FOREIGN PATENT DOCUMENTS

| | | | |
|---|---|---|---|
| CN | 102176985 | A | 9/2011 |
| CN | 102605280 | | 7/2012 |
| CN | 102712972 | A | 10/2012 |
| CN | 103710640 | A | 4/2014 |
| JP | 55114404 | | 9/1980 |
| JP | S5831069 | A | 2/1983 |
| JP | 6127320 | | 2/1986 |
| JP | H01219121 | A | 9/1989 |
| JP | 02197383 | | 8/1990 |
| JP | 04190902 | | 7/1992 |
| JP | 06198394 | A | 7/1994 |
| JP | 1088231 | A | 4/1998 |
| JP | 2913426 | B2 | 6/1999 |
| JP | 2000263103 | | 9/2000 |
| JP | 2002194431 | | 7/2002 |
| JP | 2002210502 | A | 7/2002 |
| JP | 2002256380 | A | 9/2002 |
| JP | 3333619 | | 10/2002 |
| JP | 2005068519 | A | 3/2005 |
| JP | 2006111918 | | 4/2006 |
| JP | 2008308736 | A | 12/2008 |
| JP | 2009235524 | | 10/2009 |
| JP | 2010106298 | | 5/2010 |
| JP | 2010280976 | A | 12/2010 |
| JP | 2011202214 | A | 10/2011 |
| JP | 2013095927 | | 5/2013 |
| JP | 5354164 | B2 | 11/2013 |
| JP | 5477457 | B2 | 4/2014 |
| JP | 2014038200 | | 8/2016 |
| WO | 2013051231 | A1 | 4/2013 |
| WO | 2013091845 | A1 | 6/2013 |
| WO | 2014141697 | A1 | 9/2014 |
| WO | 2015140846 | A1 | 9/2015 |

OTHER PUBLICATIONS

Supplementary European Search Report for Application No. 14886339.2, dated Feb. 15, 2017, 7 pages.

Japanese Office Action with partial English language translation for Application No. 2016-508308, dated Dec. 20, 2016, 3 pages.

Chinese Office Action for Chinese Application No. 201480077199.6, dated Oct. 23, 2017 with Concise Statement of Relevance, 10 pages.

Korean Office Action for Korean Application No. 10-2016-7025832, dated Aug. 10, 2017, including Concise Statement of Relevance of Office Action, 8 pages.

International Search Report and Written Opinion for International Application No. PCT/JP2014/004631, dated Jan. 6, 2015, 5 pages.

Iron and Steel, 66 (1980), pp. 201-210.

Chinese Office Action for Chinese Application No. 201480077199.6, dated Apr. 26, 2017 with search report and concise statement of relevance, 10 pages.

Non Final Office Action for U.S. Appl. No. 15/304,702, dated Nov. 14, 2018, 25 pages.

* cited by examiner

HIGH TOUGHNESS AND HIGH TENSILE STRENGTH THICK STEEL PLATE AND PRODUCTION METHOD THEREFOR

CROSS REFERENCE TO RELATED APPLICATIONS

This is the U.S. National Phase application of PCT/JP2014/004631, filed Sep. 9, 2014, which claims priority to Japanese Patent Application No. 2014-058611, filed Mar. 20, 2014, the disclosures of each of these applications being incorporated herein by reference in their entireties for all purposes.

TECHNICAL FIELD

The disclosure relates to a thick steel plate having excellent strength, toughness, and weldability and used in steel structures such as buildings, bridges, ships, offshore structures, construction machinery, tanks, and penstocks, and a production method therefor. The disclosure particularly provides a high toughness and high tensile strength thick steel plate whose plate thickness is 100 mm or more and reduction of area in a center of the plate thickness by tension in the plate thickness direction is 40% or more, and a production method therefor.

BACKGROUND

In the case of using a steel material in the fields such as buildings, bridges, ships, offshore structures, construction machinery, tanks, and penstocks, the steel material is made into a desired shape by welding according to the shape of the steel structure. Steel structures are becoming increasingly larger in size in recent years, and the use of stronger and thicker steel materials is growing markedly.

A thick steel plate having a plate thickness of 100 mm or more is typically produced by blooming a large steel ingot produced by ingot casting and then hot rolling the obtained slab. In this ingot casting and blooming process, however, a concentrated segregation area of a hot top portion or a negative segregation area of a steel ingot bottom portion needs to be discarded. This hinders yield improvement, and causes higher manufacturing cost and longer construction time.

On the other hand, in the case of producing a thick steel plate having a plate thickness of 100 mm or more by a process that uses a continuously-cast slab as a raw material, the aforementioned concern does not exist, but the working reduction to the product thickness is low because the thickness of the continuously-cast slab is smaller than the slab produced by ingot casting. Moreover, the general tendency to require stronger and thicker steel materials in recent years has increased the amount of alloying element added to ensure necessary properties. This causes new problems such as center porosity deriving from center segregation and inner quality degradation due to upsizing.

To solve these problems, the following techniques have been proposed to, in a process of producing an ultra-thick steel plate from a continuously-cast slab, compress center porosity to improve the properties of the center segregation area in the steel plate.

For example, Non Patent Literature (NPL) 1 describes the technique of compressing center porosity by increasing the rolling shape ratio during hot rolling of a continuously-cast slab.

Patent Literatures (PTLs) 1 and 2 describe the techniques of compressing center porosity in a continuously-cast slab by, when producing the continuously-cast slab, working the material using rolls or flat dies in a continuous casting machine.

PTL 3 describes the technique of compressing center porosity by performing forging before hot rolling when producing a thick steel plate with a cumulative working reduction of 70% or less from a continuously-cast slab.

PTL 4 describes the technique of not only eliminating center porosity but also reducing the center segregation zone to improve the resistance to temper embrittlement by, when producing an ultra-thick steel plate from a continuously-cast slab through forging and thick plate rolling with a total working reduction of 35% to 67%, holding the center of the plate thickness of the raw material at a temperature of 1200° C. or more for 20 hours or more before forging and setting the working reduction of the forging to 16% or more.

PTL 5 describes the technique of remedying center porosity and center segregation by cross-forging a continuously-cast slab and then hot rolling the slab.

PTL 6 describes the technique relating to the method of producing a thick steel plate having a tensile strength of 588 MPa or more with center porosity being eliminated and the center segregation zone being reduced, by holding a continuously-cast slab at a temperature of 1200° C. or more for 20 hours or more, setting the working reduction of the forging to 17% or more, performing thick plate rolling so that the total working reduction including the forging is in the range of 23% to 50%, and applying quenching twice after the thick plate rolling.

PTL 7 describes the technique relating to the method of producing a thick steel plate excellent in weldability and ductility in the plate thickness direction by reheating a continuously-cast slab having a specific composition to 1100° C. to 1350° C., with a cumulative working reduction of 15% or more and a strain rate of 0.05/s to 3/s at 1000° C. or more.

CITATION LIST

Patent Literatures

PTL 1: JP S55-114404 A
PTL 2: JP S61-27320 A
PTL 3: JP 3333619 B2
PTL 4: JP 2002-194431 A
PTL 5: JP 2000-263103 A
PTL 6: JP 2006-111918 A
PTL 7: JP 2010-106298 A

Non-Patent Literatures

NPL 1: Iron and Steel, 66 (1980), pp. 201-210

SUMMARY

Technical Problem

However, the technique described in NPL 1 needs repeated rolling with a high rolling shape ratio, to obtain a steel plate having good inner quality. This exceeds the upper limit of the equipment specifications of the mill, and poses a production problem. If a typical method is used for rolling, the center of the plate thickness cannot be worked sufficiently, as a result of which center porosity may remain and degrade inner quality.

The techniques described in PTLs 1 and 2 need a larger continuous casting line to produce a thick steel plate of 100 mm or more in plate thickness. This requires a heavy investment in equipment.

The techniques described in PTLs 3 to 7 are effective in center porosity reduction and center segregation zone improvement. However, in the case where the techniques are applied to the production of a thick steel plate with a large addition amount of alloy and a yield strength of 620 MPa or more, defect sensitivity increases due to the strengthening of the material, and so the elongation and toughness of the center of the plate thickness are both insufficient.

It could therefore be helpful to provide a high tensile strength thick steel plate having excellent strength and toughness in a center of the plate thickness with no need for a larger continuous casting line or mill even in the case of producing a high strength thick steel plate for which the addition amount of alloying element needs to be increased, and a production method therefor. The high tensile strength thick steel plate has a plate thickness of 100 mm or more.

Solution to Problem

For thick steel plates of 100 mm or more in plate thickness in particular, we studied the control factors of the microstructure inside the steel plate with regard to the strength, toughness, and elongation of the center of the plate thickness, and made the following discoveries.

(A) To obtain good strength and toughness in the center of the plate thickness that has a significantly lower cooling rate than the steel plate surface, it is important to appropriately select the steel composition so that the microstructure is a martensite and/or bainite structure even with a lower cooling rate.

(B) To ensure good ductility in the center of the plate thickness of the thick steel plate that tends to have lower ductility due to strengthening and have higher defect sensitivity with respect to ductility, it is important to manage the die shape and total working reduction in hot forging and the strain rate, per-pass working reduction, and working time in the forging to compress center porosity and render it harmless.

The disclosure is based on the aforementioned discoveries and further studies. We thus provide the following.

1. A high toughness and high tensile strength thick steel plate having a plate thickness of 100 mm or more, wherein a reduction of area in a center of the plate thickness by tension in a plate thickness direction is 40% or more.

2. The high toughness and high tensile strength thick steel plate according to the foregoing 1, comprising (consisting of), in mass %: 0.08% to 0.20% of C; 0.40% or less of Si; 0.5% to 5.0% of Mn; 0.015% or less of P; 0.0050% or less of S; 3.0% or less of Cr; 5.0% or less of Ni; 0.005% to 0.020% of Ti; 0.080% or less of Al; 0.0070% or less of N; and 0.0030% or less of B, with a balance being Fe and incidental impurities, wherein a relationship in Formula (1) is satisfied:

$$Ceq^{IIW}=C+Mn/6+(Cu+Ni)/15+(Cr+Mo+V)/5\geq 0.57 \quad (1),$$

where each element symbol in Formula (1) indicates a content in steel in mass %, and the content of any element not contained in the steel is 0.

3. The high toughness and high tensile strength thick steel plate according to the foregoing 2, further comprising, in mass %, one or more selected from: 0.50% or less of Cu; 1.50% or less of Mo; 0.200% or less of V; and 0.100% or less of Nb.

4. The high toughness and high tensile strength thick steel plate according to the foregoing 2 or 3, further comprising, in mass %, one or more selected from: 0.0005% to 0.0100% of Mg; 0.01% to 0.20% of Ta; 0.005% to 0.1% of Zr; 0.001% to 0.01% of Y; 0.0005% to 0.0050% of Ca; and 0.0005% to 0.0200% of REM.

5. The high toughness and high tensile strength thick steel plate according to any one of the foregoing 1 to 4, having a yield strength of 620 MPa or more, and toughness ($_{V}E_{-40}$) of 70 J or more.

6. A production method for the high toughness and high tensile strength thick steel plate according to any one of the foregoing 1 to 5, comprising: heating a continuously-cast slab of steel to 1200° C. to 1350° C.; hot forging the steel at 1000° C. or more with a strain rate of 3/s or less and a cumulative working reduction of 15% or more, using dies such that, when a length of a shorter short side of respective short sides of the dies facing each other is 1, a length of a short side of an other one of the dies facing the shorter short side is 1.1 to 3.0; hot rolling the steel; and quenching and tempering the steel.

7. A production method for the high toughness and high tensile strength thick steel plate according to any one of the foregoing 1 to 5, comprising: heating a continuously-cast slab of steel to 1200° C. to 1350° C.; hot forging the steel at 1000° C. or more with a strain rate of 3/s or less and a cumulative working reduction of 15% or more, using dies such that, when a length of a shorter short side of respective short sides of the dies facing each other is 1, a length of a short side of an other one of the dies facing the shorter short side is 1.1 to 3.0; allowing the steel to cool; reheating the steel to an $Ac_3$ point to 1250° C.; hot rolling the steel by performing two or more passes with a per-pass working reduction of 4% or more; allowing the steel to cool; reheating the steel to the $Ac_3$ point to 1050° C.; quenching the steel to an $Ar_3$ point to 350° C.; and tempering the steel in a range of 450° C. to 700° C.

8. The production method for the high toughness and high tensile strength thick steel plate according to the foregoing 6 or 7, wherein a working reduction ratio in the high toughness and high tensile strength thick steel plate from a raw material before working is 3 or less.

9. The production method for the high toughness and high tensile strength thick steel plate according to any one of the foregoing 6 to 8, wherein in the hot forging, forging with a per-pass working reduction of 5% or more is applied one or more times.

10. The production method for the high toughness and high tensile strength thick steel plate according to any one of the foregoing 6 to 8, wherein in the hot forging, forging with a per-pass working reduction of 7% or more is applied one or more times.

11. The production method for the high toughness and high tensile strength thick steel plate according to any one of the foregoing 6 to 10, wherein in the hot forging, at least one pass has a cumulative elapsed time of 3 s or more under a load that is not less than a maximum load of the pass×0.9 and not more than the maximum load of the pass.

Advantageous Effect

With the disclosed techniques, it is possible to obtain a thick steel plate having a plate thickness of 100 mm or more with excellent yield strength and toughness of a base metal. The disclosed techniques significantly contribute to larger sizes of steel structures, improved safety of steel structures, improved yields, and shorter construction time, and so are industrially very useful. In particular, the disclosed techniques have the advantageous effect of obtaining good properties without upsizing a continuous casting line, etc. even in the case where the working reduction ratio from the raw material before working is 3 or less, while sufficient properties of the center of the plate thickness were conventionally hard to be obtained in such a case.

DETAILED DESCRIPTION

Figure 1:
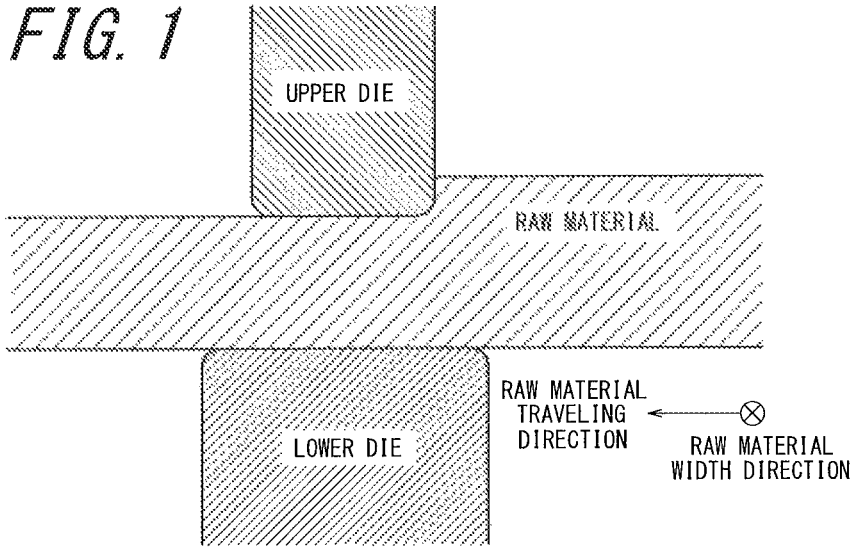
FIG. 1 is a diagram illustrating the short sides of dies facing each other.

Detailed description is given below.

The disclosure provides a forged material whose plate thickness is 100 mm or more and reduction of area in a center of the plate thickness by tension in the plate thickness direction is 40% or more. With such a structure, center porosity in the steel can be compressed to a size of 100 μm or less and rendered substantially harmless.

The high tensile strength thick steel plate also has a yield strength of 620 MPa or more. This contributes to larger sizes of steel structures and improved safety of steel structures. The aforementioned properties can be obtained even in the case where the working reduction ratio from the raw material before working is 3 or less, while conventionally these properties were hard to be obtained in such a case.

The following describes the suitable ranges of the steel plate composition according to the disclosure. The % representation of the content of each element in the steel plate composition is mass %.

C: 0.08% to 0.20%

C is an element useful in obtaining the strength required of structural steel at low cost. To achieve the effect, the C content is preferably 0.08% or more. If the C content exceeds 0.20%, the toughness of the base metal and heat-affected zone degrades significantly. The upper limit is therefore preferably 0.20%. The C content is more preferably 0.08% to 0.14%.

Si: 0.40% or Less

Si is added for deoxidation. If the Si content exceeds 0.40%, the toughness of the base metal and heat-affected zone degrades significantly. The Si content is therefore preferably 0.40% or less. The Si content is more preferably in the range of 0.05% to 0.30%, and further preferably in the range of 0.1% to 0.30%.

Mn: 0.5% to 5.0%

Mn is added to ensure the strength of the base metal. If the Mn content is less than 0.5%, the effect is not sufficient. If the Mn content exceeds 5.0%, not only the toughness of the base metal degrades but also center segregation is facilitated to cause larger porosity of the slab. The upper limit is therefore preferably 5.0%. The Mn content is more preferably in the range of 0.6% to 2.0%, and further preferably in the range of 0.6% to 1.6%.

P: 0.015% or Less

If the P content exceeds 0.015%, the toughness of the base metal and heat-affected zone degrades significantly. The P content is therefore preferably 0.015% or less. The lower limit is not particularly limited, and may be 0%.

S: 0.0050% or Less

If the S content exceeds 0.0050%, the toughness of the base metal and heat-affected zone degrades significantly. The S content is therefore preferably 0.0050% or less. The lower limit is not particularly limited, and may be 0%.

Cr: 3.0% or Less

Cr is an element effective in strengthening the base metal. However, if the Cr content is high, weldability decreases. The Cr content is therefore preferably 3.0% or less. The Cr content is more preferably 0.1% to 2.0% in terms of production cost.

Ni: 5.0% or Less

Ni is an element effective in improving the strength of steel and the toughness of the heat-affected zone. However, if the Ni content exceeds 5.0%, economic efficiency drops significantly. The Ni content is therefore preferably 5.0% or less. The Ni content is more preferably 0.5% to 4.0%.

Ti: 0.005% to 0.020%

Ti generates TiN when heated, thus effectively suppressing coarsening of austenite grains and improving the toughness of the base metal and heat-affected zone. However, if the Ti content exceeds 0.020%, Ti nitride coarsens and degrades the toughness of the base metal. Hence, in the case of adding Ti, the Ti content is preferably in the range of 0.005% to 0.020%. The Ti content is more preferably in the range of 0.008% to 0.015%.

Al: 0.080% or Less

Al is added to sufficiently deoxidize molten steel. However, if the Al content exceeds 0.080%, the amount of Al dissolving in the base metal increases, which degrades the toughness of the base metal. The Al content is therefore preferably 0.080% or less. The Al content is more preferably in the range of 0.020% to 0.080%, and further preferably in the range of 0.020% to 0.060%.

N: 0.0070% or Less

N has the effect of, by forming a nitride with Ti or the like, refining the microstructure and improving the toughness of the base metal and heat-affected zone. However, if the N content exceeds 0.0070%, the amount of N dissolving in the base metal increases, which significantly degrades the toughness of the base metal. Moreover, a coarse carbonitride is formed in the heat-affected zone, and degrades the toughness. The N content is therefore preferably 0.0070% or less. The N content is more preferably 0.0050% or less, and further preferably 0.0040% or less.

B: 0.0030% or Less

B has the effect of, by being segregated in an austenite grain boundary, suppressing ferrite transformation from the grain boundary and enhancing quench hardenability. However, if the B content exceeds 0.0030%, B precipitates as a carbonitride and decreases quench hardenability, which causes lower toughness. The B content is therefore preferably 0.0030% or less. In the case of adding B, the B content is more preferably in the range of 0.0003% to 0.0030%, and further preferably in the range of 0.0005% to 0.0020%.

In addition to the aforementioned elements, the high tensile strength steel according to the disclosure may further contain one or more selected from Cu, Mo, V, and Nb to enhance strength and toughness.

Cu: 0.50% or Less

Cu can improve the strength of steel without degrading the toughness. However, if the Cu content exceeds 0.50%, the steel plate surface cracks during hot working. The Cu content is therefore 0.50% or less.

Mo: 1.50% or Less

Mo is an element effective in strengthening the base metal. However, if the Mo content exceeds 1.50%, the precipitation of a hard alloy carbide causes an increase in strength and degrades toughness. The upper limit is therefore preferably 1.50%. The Mo content is more preferably in the range of 0.02% to 0.80%.

V: 0.200% or Less

V has the effect of improving the strength and toughness of the base metal, and also is effective in reducing solute N by precipitating as VN. However, if the V content exceeds 0.200%, the precipitation of hard VC degrades the toughness of steel. Hence, in the case of adding V, the V content is preferably 0.200% or less. The V content is more preferably in the range of 0.010% to 0.100%.

Nb: 0.100% or Less

Nb is useful as it has the effect of improving the strength of the base metal. However, if the Nb content exceeds 0.100%, the toughness of the base metal degrades significantly. The upper limit is therefore 0.100%. The Nb content is preferably 0.025% or less.

In addition to the aforementioned components, the high tensile strength steel according to the disclosure may further contain one or more selected from Mg, Ta, Zr, Y, Ca, and REM to further improve the material quality.

Mg: 0.0005% to 0.0100%

Mg is an element that forms a stable oxide at high temperature, and effectively suppresses coarsening of austenite grains in the heat-affected zone and improves the toughness of the weld. To achieve the effect, a Mg content of 0.0005% or more is effective. If the Mg content exceeds 0.0100%, the amount of inclusion increases and the toughness decreases. Hence, in the case of adding Mg, the Mg content is preferably 0.0100% or less. The Mg content is more preferably in the range of 0.0005% to 0.0050%.

Ta: 0.01% to 0.20%

Ta is effective in improving strength, when added in an appropriate amount. If the Ta content is less than 0.01%, the effect is not obvious. If the Ta content exceeds 0.20%, a precipitate is generated and causes lower toughness. The Ta content is therefore preferably 0.01% to 0.20%.

Zr: 0.005% to 0.1%

Zr is an element effective in improving strength. If the Zr content is less than 0.005%, the effect is not obvious. If the Zr content exceeds 0.1%, a coarse precipitate is generated and causes lower toughness of steel. The Zr content is therefore 0.005% to 0.1%.

Y: 0.001% to 0.01%

Y is an element that forms a stable oxide at high temperature, and effectively suppresses coarsening of austenite grains in the heat-affected zone and improves the toughness of the weld. If the Y content is less than 0.001%, the effect cannot be achieved. If the Y content exceeds 0.01%, the amount of inclusion increases and the toughness decreases. The Y content is therefore 0.001% to 0.01%.

Ca: 0.0005% to 0.0050%

Ca is an element useful in morphological control of sulfide inclusion. To achieve the effect, the Ca content needs to be 0.0005% or more. If the Ca content exceeds 0.0050%, cleanliness decreases and toughness degrades. Hence, in the case of adding Ca, the Ca content is preferably 0.0050% or less. The Ca content is more preferably in the range of 0.0005% to 0.0025%.

REM: 0.0005% to 0.0200%

REM has the effect of forming an oxide and a sulfide in steel and improving the material quality, as with Ca. To achieve the effect, the REM content needs to be 0.0005% or more. If the REM content exceeds 0.0200%, the effect saturates. Hence, in the case of adding REM, the REM content is preferably 0.0200% or less. The REM content is more preferably in the range of 0.0005% to 0.0100%.

$Ceq^{IIW}$ (%)≥0.57

In the disclosure, appropriate components need to be added to ensure high strength and good toughness in the center of the plate thickness. It is important to add components so that $Ceq^{IIW}$ (%) defined in the following Formula (1) satisfies the relationship $Ceq^{IIW} \geq 0.57$:

$$Ceq^{IIW}=C+Mn/6+(Cu+Ni)/15+(Cr+Mo+V)/5\geq 0.57 \quad (1).$$

Each element symbol in the formula indicates the content of the corresponding element (mass %).

The following describes the production conditions according to the disclosure.

In the following description, the temperature "° C." indicates the temperature in the center of the plate thickness. In particular, the disclosed method of producing a thick steel plate requires hot forging a steel raw material under the following conditions, in order to render casting defects such as center porosity in the steel raw material harmless.

Hot Working Conditions for Steel Raw Material

Heating Temperature: 1200° C. to 1350° C.

A steel raw material for a continuous-cast steel or slab having the aforementioned composition is subject to steelmaking and continuous casting by a typically known method such as a converter, an electric heating furnace, or a vacuum melting furnace, and then reheated to 1200° C. to 1350° C. If the reheating temperature is less than 1200° C., a predetermined cumulative working reduction and temperature lower limit of hot working cannot be ensured, and also the deformation resistance during hot forging is high and a sufficient per-pass working reduction cannot be ensured. As a result, a larger number of passes are needed, which not only decreases production efficiency but also makes it impossible to compress casting defects such as center porosity in the steel raw material to render them harmless. The reheating temperature is therefore 1200° C. or more. If the reheating temperature exceeds 1350° C., an excessive amount of energy is consumed and surface defects tend to occur due to scale during heating, leading to an increased mending load after hot forging. The upper limit is therefore 1350° C.

Forging Temperature of Hot Forging: 1000° C. or More

If the forging temperature of hot forging is less than 1000° C., the deformation resistance during hot forging increases and the load on the forging machine increases, making it impossible to reliably render center porosity harmless. The forging temperature is therefore 1000° C. or more. The upper limit of the forging temperature is not particularly limited, but is preferably about 1350° C. in terms of production cost.

Asymmetric Shapes of Facing Dies

Hot forging according to the disclosure is performed using a pair of facing dies whose long sides lie in the width direction of the continuously-cast slab and whose short sides lie in the traveling direction of the continuously-cast slab. Hot forging according to the disclosure has a feature that the respective short sides of the facing dies have different lengths, as illustrated in FIG. 1.

When the length of the shorter one (the short side of the upper die in FIG. 1) of the respective short sides of the facing dies is 1, the length of the short side (the short side of the lower die in FIG. 1) of the opposite die is 1.1 to 3.0 with respect to the shorter short side. In this way, the strain distribution can be made asymmetrical, and also the position of the minimum strain imparted during forging and the position of occurrence of center porosity in the continuously-cast slab can be kept from coinciding with each other. As a result, center porosity is rendered harmless more reliably.

If the ratio of the longer short side to the shorter short side is less than 1.1, the effect of rendering center porosity harmless is not sufficient. If the ratio of the longer short side to the shorter short side exceeds 3.0, the efficiency of hot forging drops significantly. It is therefore important to use, in hot forging according to the disclosure, such dies that, when the length of the shorter one of the respective short sides of the pair of dies facing each other is 1, the length of the short side facing the shorter short side is 1.1 to 3.0. Here, the die having the shorter short side may be above or below the continuously-cast slab, as long as the short side of the opposite die satisfies the aforementioned ratio. In other words, the short side of the lower die may be shorter in FIG. 1.

Figure 2:
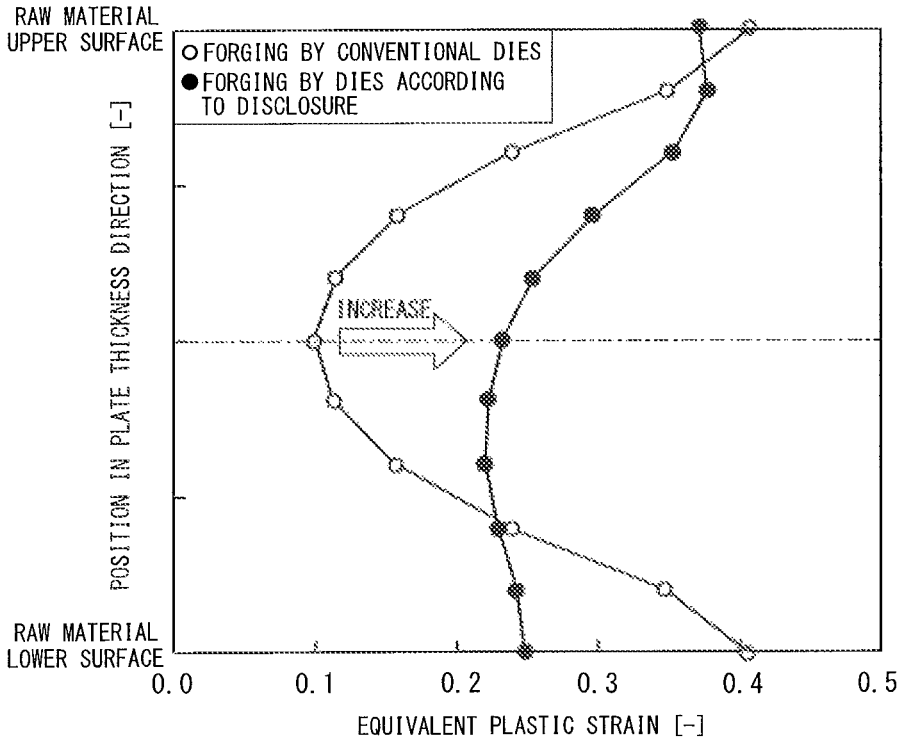
FIG. 2 is a diagram illustrating the result of calculating equivalent plastic strain in a raw material (steel plate).

FIG. 2 illustrates the result of calculating equivalent plastic strain in the raw material (steel plate) in the plate thickness direction of the raw material, in the case where the short sides of the upper and lower dies have the same length (the conventional dies indicated by the white circles in the drawing) and in the case where the ratio of the longer short side to the shorter short side is 2.5 (the dies according to the disclosure indicated by the black circles in the drawing). The conditions of hot forging using the dies are the same except the shape of the dies, where the heating temperature is 1250° C., the working start temperature is 1215° C., the working end temperature is 1050° C., the cumulative working reduction is 16%, the strain rate is 0.1/s, the maximum per-pass working reduction is 8%, and the raw material is not worked in the width direction.

As can be seen from FIG. 2, the hot forging using the dies according to the disclosure is more successful in imparting sufficient strain even to the raw material center.

Cumulative Working Reduction of Hot Forging: 15% or More

If the cumulative working reduction of hot forging is less than 15%, casting defects such as center porosity in the steel raw material cannot be compressed and rendered harmless. The cumulative rolling reduction of hot forging is therefore 15% or more. In the case where the thickness increases as a result of hot forging the continuously-cast slab in the width direction, the cumulative working reduction is measured from the increased thickness.

Strain Rate of Hot Forging: 3/s or Less

If the strain rate of hot forging exceeds 3/s, the deformation resistance during hot forging increases and the load on the forging machine increases, making it impossible to render center porosity harmless. The strain rate of hot forging is therefore 3/s or less.

If the strain rate is less than 0.01/s, hot forging takes a longer time, leading to lower productivity. The strain rate is therefore preferably 0.01/s or more. The strain rate is more preferably in the range of 0.05/s to 1/s.

Application of Forging One or More Times with Per-Pass Working Reduction in Hot Forging of 5% or More or 7% or More By increasing the working reduction in hot forging, the remaining amount of fine center porosity after forging is reduced. When forging with a per-pass rolling reduction of 5% or more is applied one or more times during hot forging, the reduction of area in the plate thickness direction tensile test is 40% or more, as center porosity in the steel is compressed to 100 μm or less in size and rendered substantially harmless. When forging with a per-pass rolling reduction of 7% or more is applied one or more times during hot forging, a product whose reduction of area in the plate thickness direction tensile test is 45% or more can be produced as the size of center porosity in the steel can be made smaller.

At Least One Pass in Hot Forging Having a Cumulative Elapsed Time of 3 s or More Under a Load that is not Less than (the Maximum Load of the Pass)×0.9 and not More than the Maximum Load of the Pass In hot forging, at least one pass has a cumulative elapsed time of 3 s or more under a load that is not less than (the maximum load of the pass)×0.9 and not more than the maximum load of the pass. Thus, center porosity diffusively bonds together and disappears, so that the reduction of area in the plate thickness direction tensile test can be improved.

In the disclosure, hot forging is followed by hot rolling to obtain a steel plate of a desired plate thickness, which may be subject to quenching-tempering processes to ensure a yield strength of 620 MPa or more and favorable toughness even in the center of the plate thickness.

Reheating Temperature of Steel Raw Material after Hot Forging: $Ac_3$ Point to 1250° C.

The steel raw material is heated to an $Ac_3$ transformation point or more, to uniformize the steel to the austenite single phase structure. The heating temperature is preferably the $Ac_3$ point or more and 1250° C. or less.

In the disclosure, the $Ac_3$ transformation point is calculated by the following Formula (2):

$$Ac_3(^\circ\,C.)=937.2-476.5C+56Si-19.7Mn-16.3Cu-26.6Ni-4.9Cr+38.1Mo+124.8V+136.3Ti+198.4Al+3315B \quad (2).$$

Each element symbol in Formula (2) indicates the content of the corresponding alloying element in the steel (mass %).

Hot Rolling Involving Two or More Passes with Per-Pass Working Reduction of 4% or More In the disclosure, after reheating to the $Ac_3$ point or more and 1250° C. or less, hot rolling involving two or more passes with a per-pass working reduction of 4% or more is preferably performed. Such rolling allows the center of the plate thickness to be worked sufficiently. This facilitates recrystallization and refines the microstructure, contributing to improved mechanical properties.

Heat Treatment Conditions after Hot Rolling

In the disclosure, the hot rolled steel raw material is then allowed to cool, reheated to the $Ac_3$ point to 1050° C., and quenched at least to an $Ar_3$ point or more and 350° C. or less, to obtain strength and toughness in the center of the plate thickness. Here, the reheating temperature is limited to 1050° C. or less, because a high reheating temperature exceeding 1050° C. causes coarsening of austenite grains and significantly degrades the toughness of the base metal.

In the disclosure, the $Ar_3$ transformation point is calculated by the following Formula (3):

$$Ar_3(^\circ\,C.)=910-310C—80Mn—20Cu—15Cr—55Ni—80Mo \quad (3).$$

Each element symbol in Formula (3) indicates the content of the corresponding element in the steel (mass %).

The temperature of the center of the plate thickness is determined by simulation calculation or the like, based on the plate thickness, the surface temperature, the cooling condition, etc. For example, the plate thickness center temperature is determined by calculating the temperature distribution in the plate thickness direction using a finite difference method.

An industrially typical method of quenching is water cooling. Since the cooling rate is desirably as high as possible, however, the cooling method may be other than water cooling. For example, gas cooling may be used.

Tempering Temperature: 450° C. to 700° C.

The quenched steel raw material is then tempered with a temperature of 450° C. to 700° C. If the tempering temperature is less than 450° C., the effect of removing residual stress is not sufficient. If the tempering temperature exceeds 700° C., various carbides precipitate and the microstructure of the base metal coarsens, resulting in significantly lower strength and toughness.

Industrially, there are instances of repeatedly quenching steel in order to make the steel tougher. While quenching may be repeatedly performed in the disclosure, at the last quenching, the steel raw material is preferably heated to the $Ac_3$ point to 1050° C., quenched to 350° C. or less, and then tempered to 450° C. to 700° C.

As described above, in the steel plate manufacture according to the disclosure, a steel plate with excellent strength and toughness can be produced by quenching and tempering.

EXAMPLES

Examples according to the disclosure are described below.

Steel of each of Nos. 1 to 35 shown in Table 1 was obtained by steelmaking and made into a continuously-cast slab, and then hot worked and hot rolled to a steel plate with a plate thickness in the range of 100 mm to 240 mm under the conditions shown in Table 2. After this, the quenching-tempering processes were performed to produce the products of sample Nos. 1 to 49 shown in Table 2, which were submitted to the following tests.

I. Tensile Test

Round bar tensile test pieces (ϕ: 12.5 mm, GL: 50 mm) were collected from the center of the plate thickness of each steel plate in the rolling direction and the direction orthogonal to the rolling direction, and the yield strength (YS) and the tensile strength (TS) were measured.

II. Plate Thickness Direction Tensile Test

Three round bar tensile test pieces (ϕ: 10 mm) were collected from each steel plate in the plate thickness direction, the reduction of area after fracture was measured, and evaluation was conducted with the minimum value.

III. Charpy Impact Test

Three 2 mmV notch Charpy test pieces whose longitudinal direction is the rolling direction were collected from the center of the plate thickness of each steel plate, absorbed energy ($_{\nu}E_{-40}$) was measured for each test piece by a Charpy impact test at −40° C., and the average of the three test pieces was calculated.

Table 2 shows the test results.

TABLE 1

| | | Chemical composition (mass %) | | | | | | | | | | | | |
|---|---|---|---|---|---|---|---|---|---|---|---|---|---|---|
| Category | Steel No | C | Si | Mn | P | S | Cr | Ni | Ti | Al | N | B | Cu | Mo |
| Steel of composition conforming to suitable range | 1 | 0.083 | 0.20 | 1.5 | 0.006 | 0.0010 | 0.9 | 0.5 | 0.010 | 0.045 | 0.0032 | 0.0012 | 0.25 | 0.25 |
| | 2 | 0.085 | 0.08 | 1.4 | 0.005 | 0.0011 | 0.9 | 0.9 | 0.008 | 0.048 | 0.0029 | 0.0011 | 0.20 | 0.30 |
| | 3 | 0.108 | 0.20 | 1.0 | 0.006 | 0.0010 | 0.7 | 0.9 | 0.009 | 0.050 | 0.0030 | 0.0012 | 0.25 | 0.45 |
| | 4 | 0.110 | 0.20 | 1.1 | 0.004 | 0.0005 | 0.8 | 3.6 | 0.008 | 0.025 | 0.0033 | 0.0010 | 0.20 | 0.50 |
| | 5 | 0.112 | 0.21 | 0.9 | 0.005 | 0.0004 | 1.2 | 3.6 | 0.008 | 0.045 | 0.0038 | 0.0010 | 0.21 | 0.49 |
| | 6 | 0.119 | 0.19 | 1.1 | 0.005 | 0.0008 | 1.0 | 2.0 | 0.010 | 0.045 | 0.0028 | 0.0010 | 0.20 | 0.48 |
| | 7 | 0.123 | 0.21 | 1.2 | 0.004 | 0.0006 | 1.0 | 2.1 | 0.011 | 0.045 | 0.0030 | 0.0011 | 0.19 | 0.52 |
| | 8 | 0.120 | 0.20 | 0.8 | 0.006 | 0.0008 | 1.5 | 2.9 | 0.010 | 0.035 | 0.0032 | 0.0008 | 0.20 | 0.55 |
| | 9 | 0.120 | 0.20 | 1.2 | 0.003 | 0.0005 | 0.9 | 3.6 | 0.005 | 0.065 | 0.0045 | 0.0012 | 0.20 | 0.50 |
| | 10 | 0.120 | 0.20 | 1.2 | 0.004 | 0.0006 | 0.9 | 2.5 | 0.010 | 0.040 | 0.0025 | 0.0009 | 0.20 | 0.50 |
| | 11 | 0.120 | 0.20 | 1.2 | 0.005 | 0.0004 | 0.9 | 2.0 | 0.010 | 0.045 | 0.0026 | 0.0012 | 0.20 | 0.50 |
| | 12 | 0.125 | 0.23 | 1.2 | 0.005 | 0.0006 | 1.0 | 3.8 | 0.012 | 0.060 | 0.0040 | 0.0010 | 0.22 | 0.55 |
| | 13 | 0.125 | 0.19 | 1.1 | 0.005 | 0.0006 | 0.8 | 3.2 | 0.010 | 0.055 | 0.0032 | 0.0012 | 0.20 | 0.50 |
| | 14 | 0.160 | 0.22 | 2.5 | 0.004 | 0.0005 | 0.8 | 2.0 | 0.008 | 0.048 | 0.0029 | 0.0009 | 0.20 | — |
| | 15 | 0.182 | 0.26 | 0.6 | 0.003 | 0.0003 | 0.0 | 4.5 | 0.009 | 0.053 | 0.0025 | 0.0008 | — | 0.50 |
| | 16 | 0.195 | 0.20 | 0.9 | 0.006 | 0.0009 | 2.5 | 2.2 | 0.011 | 0.050 | 0.0028 | 0.0012 | — | — |
| | 17 | 0.125 | 0.20 | 1.2 | 0.006 | 0.0005 | 0.7 | 2.0 | 0.009 | 0.045 | 0.0020 | 0.0000 | 0.15 | 0.45 |
| | 18 | 0.119 | 0.20 | 1.1 | 0.005 | 0.0008 | 0.9 | 1.9 | 0.012 | 0.005 | 0.0025 | 0.0011 | 0.21 | 0.50 |
| | 19 | 0.140 | 0.05 | 0.6 | 0.003 | 0.0006 | 2.3 | 0.0 | 0.009 | 0.025 | 0.0040 | 0.0010 | — | 1.40 |
| | 20 | 0.120 | 0.18 | 1.1 | 0.003 | 0.0004 | 0.9 | 1.8 | 0.011 | 0.035 | 0.0028 | 0.0012 | 0.20 | 0.50 |
| | 21 | 0.130 | 0.26 | 1.1 | 0.005 | 0.0012 | 1.0 | 0.9 | 0.008 | 0.004 | 0.0022 | 0.0006 | 0.25 | 0.45 |
| | 22 | 0.142 | 0.19 | 1.3 | 0.006 | 0.0009 | 0.6 | 1.5 | 0.009 | 0.030 | 0.0028 | 0.0009 | 0.30 | 0.50 |
| | 23 | 0.115 | 0.30 | 1.1 | 0.006 | 0.0010 | 0.7 | 0.5 | 0.010 | 0.040 | 0.0030 | 0.0010 | 0.20 | 0.45 |
| | 24 | 0.122 | 0.22 | 0.6 | 0.005 | 0.0008 | 0.9 | 1.0 | 0.009 | 0.035 | 0.0028 | 0.0006 | 0.25 | 0.45 |
| Steel of composition not conforming to suitable range | 25 | 0.228 | 0.24 | 1.3 | 0.005 | 0.0009 | 1.1 | 0.6 | 0.009 | 0.043 | 0.0030 | 0.0012 | 0.21 | 0.44 |
| | 26 | 0.152 | 0.55 | 1.0 | 0.006 | 0.0006 | 0.9 | 0.9 | 0.010 | 0.044 | 0.0032 | 0.0015 | 0.18 | 0.52 |
| | 27 | 0.085 | 0.40 | 0.3 | 0.009 | 0.0015 | 1.2 | 1.0 | 0.009 | 0.050 | 0.0032 | 0.0012 | 0.23 | 0.58 |
| | 28 | 0.131 | 0.35 | 1.2 | 0.020 | 0.0012 | 1.0 | 0.5 | 0.011 | 0.045 | 0.0038 | 0.0009 | 0.25 | 0.50 |
| | 29 | 0.141 | 0.15 | 1.3 | 0.009 | 0.0070 | 1.1 | 1.3 | 0.011 | 0.025 | 0.0055 | 0.0006 | 0.19 | 0.44 |
| | 30 | 0.123 | 0.26 | 1.5 | 0.006 | 0.0005 | 0.8 | 2.0 | 0.003 | 0.050 | 0.0040 | 0.0005 | — | 0.35 |
| | 31 | 0.133 | 0.29 | 1.1 | 0.005 | 0.0006 | 1.1 | 2.1 | 0.024 | 0.035 | 0.0045 | 0.0008 | — | 0.60 |
| | 32 | 0.122 | 0.26 | 1.1 | 0.005 | 0.0009 | 1.0 | 1.5 | 0.011 | 0.095 | 0.0045 | 0.0006 | 0.45 | 0.45 |
| | 33 | 0.118 | 0.26 | 1.1 | 0.009 | 0.0006 | 0.8 | 2.0 | 0.006 | 0.040 | 0.0075 | 0.0005 | 0.33 | 0.58 |
| | 34 | 0.133 | 0.26 | 1.1 | 0.010 | 0.0010 | 0.8 | 2.0 | 0.008 | 0.050 | 0.0030 | 0.0040 | 0.25 | 0.49 |
| | 35 | 0.115 | 0.15 | 0.8 | 0.010 | 0.0015 | 0.6 | 1.0 | 0.012 | 0.035 | 0.0030 | 0.0009 | 0.15 | 0.50 |

| | | Chemical composition (mass %) | | | | | | | | | $Ac_3$ | $Ar_3$ |
|---|---|---|---|---|---|---|---|---|---|---|---|---|
| Category | Steel No | V | Nb | Mg | Ta | Zr | Y | Ca | REM | $Ceq^{IIW}$ | ° C. | ° C. |
| Steel of composition conforming to suitable range | 1 | 0.020 | — | — | — | — | — | 0.0015 | — | 0.61 | 885 | 702 |
| | 2 | 0.045 | — | — | — | — | — | — | 0.0115 | 0.64 | 873 | 681 |
| | 3 | 0.040 | — | — | — | — | — | 0.0016 | — | 0.58 | 883 | 696 |

TABLE 1-continued

| | | | | | | | | | | | | |
|---|---|---|---|---|---|---|---|---|---|---|---|---|
| | 4 | 0.040 | 0.012 | — | — | — | — | 0.0018 | — | 0.81 | 805 | 534 |
| | 5 | 0.041 | — | — | — | — | — | 0.0015 | — | 0.86 | 810 | 544 |
| | 6 | 0.041 | — | — | — | — | — | 0.0018 | — | 0.75 | 845 | 615 |
| | 7 | 0.040 | — | — | — | — | — | 0.0016 | — | 0.78 | 843 | 604 |
| | 8 | 0.040 | — | — | — | — | — | — | — | 0.88 | 825 | 579 |
| | 9 | 0.040 | — | — | — | — | — | 0.0015 | — | 0.84 | 807 | 526 |
| | 10 | 0.038 | — | — | — | — | — | 0.0020 | — | 0.77 | 831 | 587 |
| | 11 | 0.040 | — | — | — | — | — | 0.0015 | — | 0.75 | 846 | 613 |
| | 12 | 0.045 | — | — | — | — | — | 0.0018 | — | 0.90 | 802 | 507 |
| | 13 | 0.040 | — | — | — | — | — | — | 0.0045 | 0.80 | 815 | 551 |
| | 14 | — | — | — | — | — | — | 0.0018 | — | 0.88 | 777 | 534 |
| | 15 | — | — | — | — | — | — | — | — | 0.68 | 767 | 518 |
| | 16 | 0.080 | — | — | — | — | — | 0.0016 | — | 1.01 | 792 | 619 |
| | 17 | 0.040 | — | — | — | — | — | 0.0019 | — | 0.70 | 839 | 617 |
| | 18 | 0.045 | — | — | — | — | — | 0.0013 | — | 0.73 | 843 | 623 |
| | 19 | 0.190 | — | — | — | — | — | — | — | 1.02 | 937 | 672 |
| | 20 | 0.045 | — | 0.0020 | — | — | — | 0.0015 | — | 0.73 | 850 | 628 |
| | 21 | — | — | — | 0.055 | — | — | 0.0013 | — | 0.68 | 856 | 676 |
| | 22 | 0.015 | — | — | — | 0.023 | — | 0.0022 | — | 0.70 | 838 | 624 |
| | 23 | 0.040 | — | — | — | — | 0.004 | 0.0009 | — | 0.58 | 892 | 708 |
| | 24 | 0.060 | 0.009 | — | — | — | — | — | — | 0.59 | 879 | 715 |
| Steel of composition not conforming to suitable range | 25 | 0.038 | — | — | — | — | — | 0.0019 | — | 0.81 | 827 | 646 |
| | 26 | — | — | — | — | — | — | — | — | 0.67 | 879 | 675 |
| | 27 | 0.035 | — | — | — | — | — | 0.0025 | — | 0.58 | 919 | 736 |
| | 28 | 0.045 | — | — | — | — | — | — | 0.0083 | 0.69 | 887 | 686 |
| | 29 | 0.039 | — | — | — | — | — | 0.0010 | — | 0.77 | 840 | 635 |
| | 30 | — | — | — | — | — | — | 0.0019 | — | 0.74 | 832 | 602 |
| | 31 | 0.020 | — | — | — | — | — | — | — | 0.80 | 845 | 601 |
| | 32 | — | — | — | — | — | — | 0.0022 | — | 0.73 | 859 | 642 |
| | 33 | — | — | — | — | — | — | — | — | 0.73 | 844 | 610 |
| | 34 | — | — | — | — | — | — | 0.0022 | — | 0.72 | 848 | 615 |
| | 35 | 0.040 | — | — | — | — | — | 0.0015 | — | 0.55 | 879 | 703 |

The values of $Ceq^{IIW}$, $Ac_3$, and $Ar_3$ are respectively calculated by Formulas (1) to (3) in the Description

TABLE 2

| | | | | Hot forging | | | | | | |
|---|---|---|---|---|---|---|---|---|---|---|
| Category | Sample | Steel No. | Slab thickness (mm) | Heating temperature (° C.) | Working start temperature (° C.) | Working end temperature (° C.) | Cumulative working reduction (%) | Strain rate (s) | Maximum per-pass working reduction (%) | Maximum load holding time (s) |
| Example | 1 | 1 | 250 | 1200 | 1155 | 1020 | 20 | 0.1 | 10 | 5 |
| Example | 2 | 2 | 250 | 1270 | 1160 | 1120 | 15 | 0.1 | 7 | 3 |
| Example | 3 | 3 | 310 | 1200 | 1170 | 1020 | 15 | 0.1 | 5 | 3 |
| Example | 4 | 4 | 450 | 1250 | 1235 | 1060 | 15 | 0.1 | 10 | 3 |
| Example | 5 | 5 | 450 | 1270 | 1250 | 1080 | 20 | 0.1 | 7 | 3 |
| Example | 6 | 6 | 310 | 1270 | 1245 | 1120 | 20 | 0.1 | 10 | 3 |
| Example | 7 | 7 | 310 | 1270 | 1240 | 1120 | 20 | 0.1 | 10 | 3 |
| Example | 8 | 8 | 450 | 1270 | 1250 | 1110 | 15 | 0.1 | 5 | 3 |
| Example | 9 | 9 | 310 | 1270 | 1245 | 1100 | 20 | 0.1 | 10 | 3 |
| Example | 10 | 10 | 310 | 1250 | 1240 | 1080 | 20 | 0.1 | 7 | 3 |
| Example | 11 | 11 | 310 | 1200 | 1165 | 1050 | 20 | 0.1 | 5 | 3 |
| Example | 12 | 12 | 450 | 1270 | 1250 | 1080 | 15 | 0.1 | 10 | 3 |
| Example | 13 | 13 | 310 | 1250 | 1220 | 1120 | 20 | 0.1 | 7 | 3 |
| Example | 14 | 14 | 310 | 1250 | 1215 | 1150 | 20 | 0.1 | 7 | 3 |
| Example | 15 | 15 | 310 | 1270 | 1245 | 1100 | 20 | 0.1 | 10 | 3 |
| Example | 16 | 16 | 310 | 1300 | 1270 | 1150 | 20 | 0.1 | 10 | 3 |
| Example | 17 | 17 | 250 | 1200 | 1160 | 1050 | 15 | 0.1 | 5 | 3 |
| Example | 18 | 18 | 310 | 1270 | 1235 | 1100 | 20 | 0.1 | 10 | 3 |
| Example | 19 | 19 | 450 | 1270 | 1255 | 1050 | 15 | 0.1 | 10 | 3 |
| Example | 20 | 20 | 310 | 1200 | 1165 | 1050 | 20 | 0.1 | 5 | 3 |
| Example | 21 | 21 | 310 | 1270 | 1235 | 1050 | 15 | 0.1 | 10 | 3 |
| Example | 22 | 22 | 310 | 1270 | 1245 | 1100 | 20 | 0.1 | 10 | 3 |
| Example | 23 | 23 | 250 | 1200 | 1135 | 1050 | 15 | 0.1 | 5 | 3 |
| Example | 24 | 24 | 250 | 1270 | 1150 | 1050 | 20 | 0.1 | 10 | 3 |
| Example | 25 | 25 | 310 | 1200 | 1165 | 1030 | 15 | 0.1 | 5 | 3 |
| Example | 26 | 26 | 250 | 1200 | 1145 | 1050 | 15 | 0.1 | 10 | 3 |
| Example | 27 | 27 | 250 | 1200 | 1150 | 1050 | 15 | 0.1 | 10 | 3 |
| Example | 28 | 28 | 310 | 1270 | 1235 | 1100 | 20 | 0.1 | 10 | 3 |
| Example | 29 | 29 | 310 | 1270 | 1240 | 1100 | 20 | 0.1 | 10 | 3 |
| Example | 30 | 30 | 310 | 1270 | 1250 | 1100 | 20 | 0.1 | 10 | 10 |
| Example | 31 | 31 | 310 | 1270 | 1250 | 1100 | 20 | 0.1 | 10 | 3 |
| Example | 32 | 32 | 310 | 1270 | 1245 | 1100 | 20 | 0.1 | 10 | 3 |
| Example | 33 | 33 | 310 | 1270 | 1235 | 1100 | 20 | 0.1 | 10 | 3 |

TABLE 2-continued

| | | | | | | | | | | |
|---|---|---|---|---|---|---|---|---|---|---|
| Example | 34 | 34 | 310 | 1270 | 1235 | 1100 | 20 | 0.1 | 10 | 3 |
| Example | 35 | 35 | 310 | 1270 | 1250 | 1100 | 20 | 0.1 | 10 | 5 |
| Comparative example | 36 | 5 | 310 | 1050 | 1005 | 850 | 15 | 0.1 | 3 | 5 |
| Comparative example | 37 | 5 | 310 | 1200 | 1165 | 900 | 15 | 0.1 | 4 | 5 |
| Comparative example | 38 | 5 | 310 | 1200 | 1165 | 1050 | 7 | 0.1 | 1 | 3 |
| Comparative example | 39 | 5 | 310 | 1200 | 1170 | 1050 | 15 | 10 | 8 | 5 |
| Example | 40 | 6 | 310 | 1250 | 1215 | 1050 | 15 | 0.1 | 8 | 3 |
| Example | 41 | 6 | 310 | 1270 | 1250 | 1050 | 20 | 0.1 | 10 | 3 |
| Example | 42 | 6 | 310 | 1270 | 1235 | 1050 | 20 | 0.1 | 5 | 3 |
| Example | 43 | 6 | 310 | 1270 | 1260 | 1050 | 20 | 0.1 | 5 | 3 |
| Example | 44 | 6 | 310 | 1270 | 1245 | 1050 | 20 | 0.1 | 10 | 3 |
| Example | 45 | 6 | 310 | 1270 | 1250 | 1050 | 20 | 0.1 | 7 | <1 |
| Example | 46 | 6 | 310 | 1270 | 1240 | 1050 | 20 | 0.1 | 5 | 3 |
| Comparative example | 47 | 6 | 310 | 1270 | 1235 | 1050 | 20 | 0.1 | 10 | 3 |
| Example | 48 | 6 | 310 | 1270 | 1245 | 1050 | 20 | 0.1 | 10 | <1 |
| Example | 49 | 6 | 310 | 1270 | 1245 | 1050 | 20 | 0.1 | 10 | 3 |

| | | Hot forging | | Hot rolling | | | | |
|---|---|---|---|---|---|---|---|---|
| Category | Sample | Working in width direction | Die shape ratio | Heating temperature (° C.) | Working reduction (%) | Rolling condition (Note 1) | Plate thickness (nm) | Working reduction from slab |
| Example | 1 | Worked | 1.1 | 1150 | 55 | Conforming | 100 | 2.5 |
| Example | 2 | Not worked | 1.1 | 1150 | 39 | Conforming | 130 | 1.9 |
| Example | 3 | Not worked | 1.5 | 1100 | 51 | Conforming | 130 | 2.4 |
| Example | 4 | Worked | 1.5 | 1200 | 45 | Conforming | 210 | 2.1 |
| Example | 5 | Worked | 1.5 | 1080 | 47 | Conforming | 210 | 2.1 |
| Example | 6 | Worked | 1.5 | 1130 | 45 | Conforming | 150 | 2.1 |
| Example | 7 | Worked | 1.5 | 1130 | 32 | Conforming | 180 | 1.7 |
| Example | 8 | Worked | 1.5 | 1130 | 50 | Conforming | 210 | 2.1 |
| Example | 9 | Worked | 1.5 | 1170 | 20 | Conforming | 210 | 1.5 |
| Example | 10 | Worked | 1.5 | 1080 | 32 | Conforming | 180 | 1.7 |
| Example | 11 | Not worked | 1.5 | 1130 | 27 | Conforming | 180 | 1.7 |
| Example | 12 | Worked | 2.5 | 1200 | 42 | Conforming | 240 | 1.9 |
| Example | 13 | Not worked | 1.5 | 1150 | 27 | Conforming | 180 | 1.7 |
| Example | 14 | Not worked | 1.5 | 1150 | 40 | Conforming | 150 | 2.1 |
| Example | 15 | Worked | 2 | 1200 | 32 | Conforming | 180 | 1.7 |
| Example | 16 | Worked | 2 | 1200 | 45 | Conforming | 150 | 2.1 |
| Example | 17 | Not worked | 1.5 | 1130 | 53 | Conforming | 100 | 2.5 |
| Example | 18 | Worked | 1.5 | 1170 | 45 | Conforming | 150 | 2.1 |
| Example | 19 | Worked | 1.5 | 1200 | 50 | Conforming | 210 | 2.1 |
| Example | 20 | Not worked | 1.5 | 1130 | 40 | Conforming | 150 | 2.1 |
| Example | 21 | Worked | 1.5 | 1170 | 56 | Conforming | 130 | 2.4 |
| Example | 22 | Worked | 1.5 | 1200 | 53 | Conforming | 130 | 2.4 |
| Example | 23 | Not worked | 1.5 | 1130 | 53 | Conforming | 100 | 2.5 |
| Example | 24 | Not worked | 1.5 | 1130 | 50 | Conforming | 100 | 2.5 |
| Example | 25 | Not worked | 1.5 | 1100 | 32 | Conforming | 100 | 1.7 |
| Example | 26 | Worked | 1.1 | 1130 | 58 | Conforming | 100 | 2.5 |
| Example | 27 | Worked | 1.1 | 1130 | 58 | Conforming | 100 | 2.5 |
| Example | 28 | Worked | 1.5 | 1200 | 45 | Conforming | 150 | 2.1 |
| Example | 29 | Worked | 1.5 | 1170 | 45 | Conforming | 150 | 2.1 |
| Example | 30 | Worked | 1.5 | 1200 | 45 | Conforming | 150 | 2.1 |
| Example | 31 | Worked | 1.5 | 1130 | 45 | Conforming | 150 | 2.1 |
| Example | 32 | Worked | 1.5 | 1170 | 45 | Conforming | 150 | 2.1 |
| Example | 33 | Worked | 1.5 | 1200 | 45 | Conforming | 150 | 2.1 |
| Example | 34 | Worked | 1.5 | 1200 | 32 | Conforming | 180 | 1.7 |
| Example | 35 | Worked | 1.5 | 1200 | 32 | Conforming | 180 | 1.7 |
| Comparative example | 36 | Not worked | 1.5 | 1150 | 43 | Conforming | 150 | 2.1 |
| Comparative example | 37 | Worked | 1.5 | 1150 | 48 | Conforming | 150 | 2.1 |
| Comparative example | 38 | Not worked | 1.5 | 1150 | 48 | Conforming | 150 | 2.1 |
| Comparative example | 39 | Not worked | 1.5 | 1100 | 43 | Conforming | 150 | 2.1 |
| Example | 40 | Worked | 1.5 | 800 | 48 | Conforming | 150 | 2.1 |
| Example | 41 | Worked | 1.5 | 1150 | 32 | Conforming | 180 | 1.7 |
| Example | 42 | Worked | 1.5 | 1150 | 32 | Conforming | 180 | 1.7 |
| Example | 43 | Worked | 1.5 | 1100 | 32 | Conforming | 180 | 1.7 |
| Example | 44 | Worked | 1.5 | 1100 | 32 | Conforming | 180 | 1.7 |
| Example | 45 | Worked | 1.5 | 1100 | 32 | Conforming | 180 | 1.7 |
| Example | 46 | Worked | 1.5 | 1100 | 32 | Conforming | 180 | 1.7 |
| Comparative example | 47 | Not worked | 1 | 1100 | 27 | Conforming | 180 | 1.7 |

TABLE 2-continued

| | | | | | | | | |
|---|---|---|---|---|---|---|---|---|
| Example | 48 | Worked | 1.5 | 1100 | 32 | Conforming | 180 | 1.7 |
| Example | 49 | Worked | 1.5 | 1150 | 32 | Nonconforming | 180 | 1.7 |

| | | Heat treatment condition in last heat treatment | | | | Base metal property | | | |
|---|---|---|---|---|---|---|---|---|---|
| Category | Sample | Reheating temperature (° C.) | Holding time (min) | Cooling stop temperature (° C.) | Tempering temperature (° C.) | YS (MPa) | TS (MPa) | $vE_{40}$ (J) | Reduction of area by tension in plate thickness direction (%) |
| Example | 1 | 1000 | 10 | 150 | 660 | 715 | 803 | 135 | 65 |
| Example | 2 | 900 | 30 | 100 | 630 | 701 | 795 | 206 | 70 |
| Example | 3 | 900 | 30 | 100 | 550 | 718 | 809 | 221 | 65 |
| Example | 4 | 900 | 30 | 100 | 645 | 739 | 821 | 173 | 60 |
| Example | 5 | 900 | 30 | 100 | 650 | 755 | 846 | 193 | 50 |
| Example | 6 | 900 | 30 | 150 | 630 | 755 | 846 | 215 | 70 |
| Example | 7 | 900 | 30 | 100 | 630 | 773 | 865 | 195 | 65 |
| Example | 8 | 930 | 10 | 100 | 645 | 763 | 852 | 148 | 40 |
| Example | 9 | 900 | 30 | 100 | 650 | 786 | 869 | 225 | 55 |
| Example | 10 | 880 | 10 | 100 | 640 | 728 | 815 | 218 | 45 |
| Example | 11 | 850 | 30 | 100 | 630 | 745 | 832 | 205 | 60 |
| Example | 12 | 900 | 60 | 100 | 600 | 736 | 829 | 195 | 65 |
| Example | 13 | 900 | 30 | 200 | 630 | 728 | 823 | 250 | 70 |
| Example | 14 | 900 | 30 | 100 | 630 | 748 | 821 | 203 | 65 |
| Example | 15 | 900 | 30 | 100 | 650 | 753 | 836 | 203 | 70 |
| Example | 16 | 900 | 30 | 150 | 650 | 747 | 827 | 220 | 70 |
| Example | 17 | 900 | 10 | 100 | 650 | 715 | 807 | 125 | 65 |
| Example | 18 | 900 | 30 | 150 | 630 | 745 | 823 | 183 | 60 |
| Example | 19 | 950 | 60 | 100 | 660 | 759 | 834 | 145 | 50 |
| Example | 20 | 900 | 30 | 150 | 630 | 726 | 811 | 195 | 45 |
| Example | 21 | 900 | 30 | 100 | 630 | 721 | 824 | 165 | 50 |
| Example | 22 | 950 | 30 | 100 | 630 | 733 | 816 | 185 | 60 |
| Example | 23 | 900 | 30 | 150 | 630 | 756 | 842 | 190 | 45 |
| Example | 24 | 900 | 30 | 100 | 630 | 768 | 856 | 145 | 50 |
| Example | 25 | 900 | 30 | 100 | 600 | 792 | 905 | 50 | 45 |
| Example | 26 | 900 | 30 | 150 | 660 | 783 | 882 | 58 | 70 |
| Example | 27 | 900 | 10 | 150 | 660 | 634 | 738 | 26 | 65 |
| Example | 28 | 900 | 30 | 150 | 630 | 745 | 832 | 18 | 60 |
| Example | 29 | 900 | 30 | 150 | 630 | 738 | 829 | 22 | 70 |
| Example | 30 | 900 | 30 | 150 | 630 | 708 | 812 | 41 | 65 |
| Example | 31 | 900 | 30 | 150 | 630 | 756 | 841 | 29 | 65 |
| Example | 32 | 900 | 30 | 150 | 630 | 748 | 859 | 55 | 70 |
| Example | 33 | 900 | 30 | 150 | 630 | 730 | 819 | 20 | 65 |
| Example | 34 | 900 | 30 | 100 | 630 | 741 | 869 | 26 | 60 |
| Example | 35 | 900 | 30 | 100 | 630 | 585 | 673 | 32 | 65 |
| Comparative example | 36 | 900 | 30 | 150 | 630 | 732 | 816 | 105 | 20 |
| Comparative example | 37 | 900 | 30 | 150 | 630 | 711 | 803 | 95 | 15 |
| Comparative example | 38 | 900 | 30 | 100 | 630 | 724 | 812 | 85 | 25 |
| Comparative example | 39 | 900 | 30 | 150 | 630 | 728 | 816 | 90 | 20 |
| Example | 40 | 900 | 30 | 100 | 630 | 731 | 805 | 22 | 45 |
| Example | 41 | 1100 | 10 | 150 | 600 | 785 | 869 | 32 | 65 |
| Example | 42 | 750 | 30 | 100 | 600 | 605 | 685 | 152 | 60 |
| Example | 43 | 900 | 30 | 480 | 600 | 529 | 663 | 28 | 55 |
| Example | 44 | 900 | 30 | 150 | 730 | 597 | 683 | 210 | 60 |
| Example | 45 | 900 | 30 | 150 | 630 | 721 | 806 | 40 | 40 |
| Example | 46 | 900 | 30 | 150 | 365 | 845 | 964 | 65 | 55 |
| Comparative example | 47 | 900 | 30 | 150 | 630 | 756 | 841 | 185 | 25 |
| Example | 48 | 900 | 30 | 150 | 630 | 743 | 832 | 46 | 45 |
| Example | 49 | 900 | 30 | 150 | 645 | 712 | 815 | 26 | 45 |

(Note 1)
Conforming: two or more passes with per-pass working reduction of 4% of more were performed.

As can be seen from the results shown in Table 2, the steel plates (sample Nos. 1 to 35, 40 to 44, 46, 48, and 49) whose steel forging conditions conform to the ranges according to the disclosure each have excellent plate thickness direction tensile properties, with the reduction of area in the plate thickness direction tensile test being 40% or more. Moreover, the steel plates (sample Nos. 1 to 24) whose steel production conditions and chemical compositions both conform to the suitable ranges according to the disclosure each have excellent base metal strength and toughness and excellent plate thickness direction tensile properties, with the YS being 620 MPa or more, the TS being 720 MPa or more, the base metal toughness ($_{\nu}E_{-40}$) being 70 J or more, and the reduction of area in the plate thickness direction tensile test being 40% or more.

In the case where the steel production conditions do not conform to the disclosed ranges as in sample Nos. 36 to 49, the properties of YS, TS, toughness ($_{\nu}E_{-40}$), and reduction of area in the plate thickness direction tensile test do not conform to the desired properties and are lower than the properties of the samples according to the disclosure.

The invention claimed is:

1. A high toughness and high tensile strength thick steel plate having a plate thickness of 100 mm or more, and having a yield strength of 620 MPa or more, and a toughness ($_{\nu}E_{-40}$) of 70 J or more, and wherein a reduction of area value of the steel plate is 40% or more, measured with a tensile test piece obtained from a center position of the plate along a thickness direction of the plate.

2. The high toughness and high tensile strength thick steel plate according to claim 1, comprising, in mass %:

0.08% to 0.20% of C;
0.40% or less of Si;
0.5% to 5.0% of Mn;
0.015% or less of P;
0.0050% or less of S;
3.0% or less of Cr;
5.0% or less of Ni;
0.005% to 0.020% of Ti;
0.080% or less of Al;
0.0070% or less of N; and
0.0030% or less of B,
with a balance being Fe and incidental impurities,
wherein a relationship in Formula (1) is satisfied:

$$Ceq^{IIW}=C+Mn/6+(Cu+Ni)/15+(Cr+Mo+V)/5\geq 0.57 \quad (1),$$

where each element symbol in Formula (1) Indicates a content in steel in mass %, and the content of any element not contained in the steel is 0.

3. The high toughness and high tensile strength thick steel plate according to claim 2, further comprising, in mass %, one or more selected from:

0.50% or less of Cu;
1.50% or less of Mo;
0.200% or less of V;
0.100% or less of Nb;
0.0005% to 0.0100% of Mg;
0.01% to 0.20% of Ta;
0.005% to 0.1% of Zr;
0.001% to 0.01% of Y;
0.0005% to 0.0050% of Ca; and
0.0005% to 0.0200% of REM.

4. A production method for a high toughness and high tensile strength thick steel plate having a plate thickness of 100 mm or more and having a yield strength of 620 MPa or more, and a toughness ($_{\nu}E_{-40}$) of 70 J or more, comprising:

heating a continuously-cast slab of steel to 1200° C. to 1350° C.;

hot forging the steel at 1000° C. or more with a strain rate of 3/s or less and a cumulative rolling reduction of 15% or more, using dies such that, when a length of a shorter short side of respective short sides of the dies facing each other is 1, a length of a short side of an other one of the dies facing the shorter short side is 1.1 to 3.0;

hot rolling the steel; and quenching and tempering the steel, wherein a reduction of area value of the steel plate is 40% or more, measured with a tensile test niece obtained from a center position of the plate along a thickness direction of the plate.

5. A production method for the high toughness and high tensile strength thick steel plate according to claim 4, further comprising:

allowing the steel to cool after hot forging;

reheating the steel to an $Ac_3$ point to 1250° C.;

hot rolling the steel by performing two or more passes with a per-pass rolling reduction of 4% or more;

allowing the steel to cool;

reheating the steel to the $Ac_3$ point to 1050° C.;

quenching the steel to an $Ar_3$ point to 350° C.; and tempering the steel in a range of 450° C. to 700° C.

6. The production method for the high toughness and high tensile strength thick steel plate according to claim 4, wherein a rolling reduction ratio in the high toughness and high tensile strength thick steel plate from a raw material before working is 3 or less.

7. The production method for the high toughness and high tensile strength thick steel plate according to claim 4, wherein in the hot forging, forging with a per-pass rolling reduction of 5% or more is applied one or more times, or wherein in the hot forging, forging with a per-pass rolling reduction of 7% or more is applied one or more times.

8. The production method for the high toughness and high tensile strength thick steel plate according to claim 4, wherein in the hot forging, at least one pass has a cumulative elapsed time of 3 s or more under a load that is not less than a maximum load of the pass×0.9 and not more than the maximum load of the pass.

9. The production method for the high toughness and high tensile strength thick steel plate according to claim 4, comprising, in mass %:

0.08% to 0.20% of C;
0.40% or less of Si;
0.5% to 5.0% of Mn;
0.015% or less of P;
0.0050% or less of S;
3.0% or less of Cr;
5.0% or less of Ni;
0.005% to 0.020% of Ti;
0.080% or less of Al;
0.0070% or less of N; and
0.0030% or less of B,
with a balance being Fe and incidental impurities,
wherein a relationship in Formula (1) is satisfied:

$$Ceq^{IIW}=C+Mn/6+(Cu+Ni)/15+(Cr+Mo+V)/5\geq 0.57 \quad (1),$$

where each element symbol in Formula (1) indicates a content in steel in mass %, and the content of any element not contained in the steel is 0.

10. The production method for the high toughness and high tensile strength thick steel plate according to claim 4, further comprising, in mass %, one or more selected from:

0.50% or less of Cu;
1.50% or less of Mo;
0.200% or less of V;
0.100% or less of Nb;
0.0005% to 0.0100% of Mg;
0.01% to 0.20% of Ta;
0.005% to 0.1% of Zr;
0.001% to 0.01% of Y;
0.0005% to 0.0050% of Ca; and
0.0005% to 0.0200% of REM.

11. The production method for the high toughness and high tensile strength thick steel plate according to claim 5, wherein a rolling reduction ratio in the high toughness and high tensile strength thick steel plate from a raw material before working is 3 or less.

12. The production method for the high toughness and high tensile strength thick steel plate according to claim 5, wherein in the hot forging, forging with a per-pass rolling reduction of 5% or more is applied one or more times, or wherein in the hot forging, forging with a per-pass rolling reduction of 7% or more is applied one or more times.

13. The production method for the high toughness and high tensile strength thick steel plate according to claim 6, wherein in the hot forging, forging with a per-pass rolling reduction of 5% or more is applied one or more times, or wherein in the hot forging, forging with a per-pass rolling reduction of 7% or more is applied one or more times.

14. The production method for the high toughness and high tensile strength thick steel plate according to claim 5, wherein in the hot forging, at least one pass has a cumulative elapsed time of 3 s or more under a load that is not less than a maximum load of the pass×0.9 and not more than the maximum load of the pass.

15. The production method for the high toughness and high tensile strength thick steel plate according to claim 6, wherein in the hot forging, at least one pass has a cumulative elapsed time of 3 s or more under a load that is not less than a maximum load of the pass×0.9 and not more than the maximum load of the pass.

16. The production method for the high toughness and high tensile strength thick steel plate according to claim 7, wherein in the hot forging, at least one pass has a cumulative elapsed time of 3 s or more under a load that is not less than a maximum load of the pass×0.9 and not more than the maximum load of the pass.

* * * * *